United States Patent [19]

Roberson

[11] Patent Number: 4,691,919

[45] Date of Patent: Sep. 8, 1987

[54] THERAPY TABLE WITH FEET ANCHOR APPARATUS

[76] Inventor: Jerry L. Roberson, 301 S. Cage, Pharr, Tex. 78577

[21] Appl. No.: 930,644

[22] Filed: Nov. 13, 1986

Related U.S. Application Data

[63] Continuation-in-part of Ser. No. 869,227, Jun. 2, 1986, abandoned.

[51] Int. Cl.[4] ..... A63B 23/00

[52] U.S. Cl. ..... 272/145; 128/71

[58] Field of Search ..... 272/144, 145; 128/70, 128/1, 75, 78, 80 R, 80 A

[56] References Cited

U.S. PATENT DOCUMENTS

| | | | |
|---|---|---|---|
| 2,658,754 | 11/1953 | Courtney | 272/145 |
| 2,934,063 | 4/1960 | Elsasser | 128/71 |
| 3,561,022 | 2/1971 | James | 5/431 |
| 3,570,479 | 3/1971 | Horn | 128/71 |
| 4,136,868 | 1/1979 | Hogne | 272/144 |
| 4,232,662 | 11/1980 | Barber | 128/71 |
| 4,241,915 | 12/1980 | Noble et al. | 272/145 |
| 4,367,731 | 1/1983 | Barber | 128/71 |
| 4,383,684 | 5/1983 | Schliep | 272/145 X |
| 4,419,990 | 12/1983 | Forster | 128/75 |
| 4,438,761 | 3/1984 | McGowen | 128/75 |
| 4,444,178 | 4/1984 | Kuo | 272/145 X |

*Primary Examiner*—Richard J. Apley
*Assistant Examiner*—J. Welsh
*Attorney, Agent, or Firm*—Jerry W. Mills; Roger N. Chauza

[57] ABSTRACT

Disclosed is a therapy table including an inclined platform (14) for accommodating the torso (12) of an exerciser (10). Foot anchor apparatus (16) is provided and is adjustable connected to the inclined torso platform (14) by a telescopic connecting member (34). A pair of stationary foot supports (36) and (48) engageable with the exerciser's ankles (38) are fixed to the connecting member (34). A pair of moveable foot supports (40, 50) are fixed to a pivotal connecting member (52) which is made pivotal with respect to the frame connecting member (34). A recess edge (90) on the pivotal member (52) is engageable with the frame connecting member (34) and thus forms a stop limiting the counterclockwise rotation of the pivotal section (52). A corner edge (98) of the frame connecting member (34) abuts with an inside surface of the pivotal section (52) and thereby forms a stop limiting the clockwise rotation of the pivotal section (52).

17 Claims, 6 Drawing Figures

THERAPY TABLE WITH FEET ANCHOR APPARATUS

RELATED APPLICATION

This is a Continuation-in-Part of a parent application entitled, "Therapy Table", by Jerry Roberson, filed June 2, 1986, Ser. No. 869,227 now abandoned.

TECHNICAL FIELD OF THE INVENTION

The present invention relates in general to exercise equipment, and more particularly relates to apparatus for engaging a person's feet while reclined thereon.

BACKGROUND OF THE INVENTION

In recent years increased emphasis has been placed on the health and well-being of people. A person's physical well-being can be maintained or improved by exercising. This is evidenced by the amount of exercise equipment now available and the volumes of current literature written on the subject matter.

Dynamic exercising, that is, the physical movement of the body with or without associated exercising equipment, has a positive affect on a person's health. Static exercises have recently been found to also contribute to the mental and physical well-being of a person. Static exercising, as defined herein, is meant to embrace those types of exercises which do not necessarily involve vigorous bodily movements to provide a therapeutic effect on the musculature, skeletal or organs of the human body.

Static exercises may be of the type which require the use of the well-known gravity boots, in which a person is suspended upside down for a period of time. The therapeutic effect afforded this type of static exercise is believed to be the stretching of the body to offset the opposite effect created by gravity. The inverted posture is also known to increase the flow of blood to a person's head. Various other internal organs of the body also benefit from such a posture. However, with this approach to static exercising, the stretching of the body tissue makes the posture uncomfortable, and even untolerable only after a few minutes. Moreover, many people require the assistance of others to put them in such a suspended inverted position, and also there is always the danger of falling and injuring one's self.

Inclined tables are also well known in the art, and provide a conventional platform for either dynamic or static exercising. U.S. Pat. Nos. 2,658,754; 3,561,022; 3,570,479; 4,136,868; 4,241,915 and 4,383,684 are exemplary of the construction of such inclined tables. While any inclined structure is suitable for elevating one portion of a person's body with respect to another portion, a problem arises in preventing the person from sliding down the inclined structure. Various feet engaging structures disclosed in the noted patents anchor the exerciser's feet such that the undesired movement of the body down the incline is prevented. However, the foot engaging apparatus thus disclosed is not easily applied or engaged to a person's feet. The engagement of the feet within the anchor apparatus of the noted patents is further exacerbated because of the inclined nature of the table. By this it is meant that it becomes overly difficult, especially for aged or handicapped persons, to place their feet in the anchor apparatus while sitting or lying on the inclined table. The same problem exists when the person desires to dismount the incline table after exercising.

It can be seen from the foregoing that a need has arisen for exercise equipment which includes feet engaging apparatus that is easily applied or removed from the feet of the exerciser.

SUMMARY OF THE INVENTION

In accordance with the present invention, a therapy table is provided which substantially reduces or eliminates the shortcomings associated with the corresponding prior art exercise structures.

In accordance with the therapy table of the invention, a cushioned platform is provided, of size sufficient to accommodate the upper torso of a person's body. A support leg structure is fixed to the upper part of the platform so that it is raised substantially above the floor level, higher than the other end of the platform. Foot engaging apparatus is connected to the inclined platform by a telescopic tubular member to accommodate adjustment, based upon the height of the exerciser.

According to one embodiment of the invention, the foot engaging apparatus comprises a pair of stationary padded lateral bars fixed in a transverse manner on each side of the telescopic tubular member. Another pair of padded lateral bars are mounted transverse to another tubular section which is pivotal with respect to the stationary pair of bars. In this manner, the stationary bars engage the underside of the feet near the instep or heel bone, while the pivotal bars are swung into engagement on the top side of the feet. An exerciser can thus kick the top set of pivotal bars out of engagement with the feet to dismount the inclined platform. In addition, and while inclined, the exerciser can hook the pivotal bar with his foot and swing the padded upper bars into engagement with his feet.

The feet engaging apparatus includes stops so that the pivotal movement of the upper bars is limited with respect to clockwise and counterclockwise rotational movements. Thus, the pivotal bars can be swing out of the way for dismounting, but not out of reach for pulling the bars back into engagement. Also, when swung into engagement with the feet, the pivotal bars reach a stop so that the upper bars do not slam into the exerciser's feet.

In accordance with another embodiment of the invention, the bottom lateral bars are slideable with respect to the tubular member. In addition, the bottom lateral bars are connected by a link to the pivotal member so that as the bottom lateral bars are moved along the tubular member, the upper movable foot supports close to a position toward the bottom lateral bars, or away therefrom. This facilitates the capture and engagement of a person's feet, as well as the opening thereof by a person to initially anchor the feet therein.

BRIEF DESCRIPTION OF THE DRAWINGS

Further features and advantages of the present invention will become apparent from the description of an illustrative embodiment thereof, taken in conjunction with the accompanying drawings, in which.

DETAILED DESCRIPTION OF THE INVENTION

Figure 1:
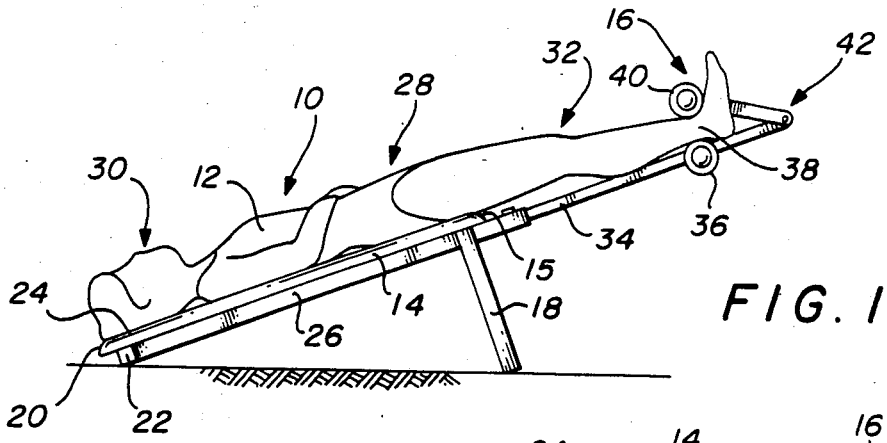
FIG. 1 is an elevations side view of the therapy table of the invention, illustrating its application for static exercising.

The application of the invention is best understood by referring first to FIG. 1 of the drawings. An exerciser 10 is shown in a prone position with the trunk or torso 12 of his body resting on a cushioned platform 14. The platform 14 is raised at one end 15 such that it is inclined and the exerciser 10 is afforded the attendant therapeutic effects. Feet engaging apparatus 16 is fixed with respect to the platform 14 for anchoring the exerciser's feet which are extended beyond the uphill end of the platform 14.

A front leg support structure 18 is fixed to the front end 15 of the inclined platform 14 to elevate such end to a height greater than the lower end 20. The inclined platform 14 is about four feet in length and the leg structure 18 is about 14 inches high, thereby providing an angle of inclination of about 20°. It has been found that with such an angle of platform inclination, the natural effects of gravity on the organs of a person are reversed.

While not shown in FIG. 1, the front leg structure 18 extends across the inclined end 15 of the platform to thereby enhance the lateral rigidity of the platform 14. A rear lateral support 22 extends across the lower end 20 of the platform 14 to provide support thereto. The platform 14 is about twenty inches wide and is constructed of a rigid material, such as ¾ths inch thick plywood, or other suitable composition material. The platform 14 also includes a foam padding covering the top surface and peripheral edge thereof. The foam padding is covered by a protective vinyl or leather material 24. The frontal leg structure 18 and the rear lateral support 22 are each constructed of a square 1.5 inch tubular steel material. The support structure 18 and 22 are fastened to the respective ends of the platform 14 by bolts or screws.

Fixed also to the platform is a longitudinal square tubular support 26 for providing longitudinal rigidity to the platform 14. The longitudinal support 26 is secured to the platform 14 by suitable fasteners, and is welded to the front and back lateral members of the supports 18 and 22 to form an "H" support structure. With a platform of the noted construction, a durable and rigid support is provided for the torsh of the exerciser 10 which is effective to elevate the lower portion of the body torsh 28 with respect to the upper or head 30 portion of the exerciser 10.

Significantly, the legs 32 of the exerciser 10 are thus free to dangle downwardly in a relaxed position from the platform inclined end 15. The torso platform 14 which does not extend substantially longer than the torso of the exerciser also enables the exerciser 10 to mount the therapy table of the invention without awkward maneuvers. In contrast with the inclined tables known in the art, an exerciser can mount the therapy table by standing near the inclined end 15 in a position straddling the foot anchor apparatus 16 and simply sit down thereon and then recline on the platform 14. After assuming the inclined prone position on the platform 14, the exerciser can then place the feet in engagement with the foot anchor apparatus 16. A therapy table constructed in accordance with the invention thereby enables aged, handicapped or infirm persons to easily utilize such structure for static or dynamic exercises.

In accordance with an important feature of the invention, the foot anchor apparatus 16 is connected to the torso platform 14 by an adjustable telescopic frame connecting member 34. The adjustable nature of the frame connecting member 34 allows the foot anchor apparatus 16 to be adjusted in accordance with the length of the exerciser's legs 32. The foot anchor apparatus 16 further includes a stationary support 36 for engaging the back side of the exerciser's ankle 38, as well as a movable upper support 40, pivotal into a position engageable with the front side of the exerciser's ankle 38. The movable support 40 includes a pivotal connection 42 so that the movable support 40 can be easily swung out of the way by simply lifting one or both of the feet. In this manner, the exerciser 10 can disengage the foot anchor apparatus 16 without the use of his hands.

Figure 2:
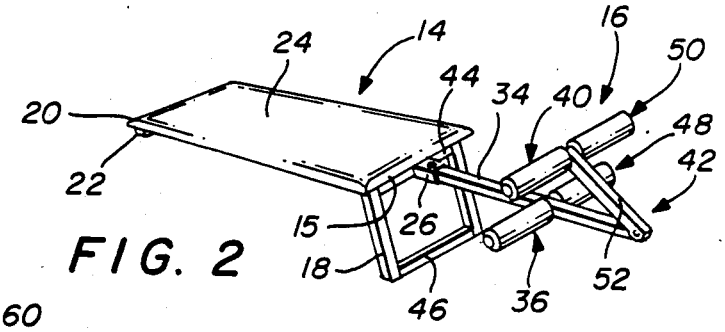
FIG. 2 is an isometric view of the therapy table.

The construction of the therapy table is shown in more detail in FIG. 2. The frontal leg supports 18 is generally of a rectangular construction. A top and bottom lateral crossbeam 44 and 46 provide rigidity to the leg structure 18. Importantly, the longitudinal frame support 26 extending under the torso platform 14 extends through the top lateral support 44 about eight inches. The frame connecting member 34 is a smaller diameter rectangular tube slideable within the longitudinal tubular support 26.

The foot anchor apparatus 16 includes a first pair of cushion-covered stub pipes 36 and 48 each welded transversely to the frame connecting member 34. Similarly, a second pair of cushion-covered stub pipes 40 and 50 are welded transversely to a pivotal tubular section 52. The foot anchor apparatus 16 of the invention thereby affords an individual front and back engagement support with the ankles of each of the exerciser's feet.

Figure 3:
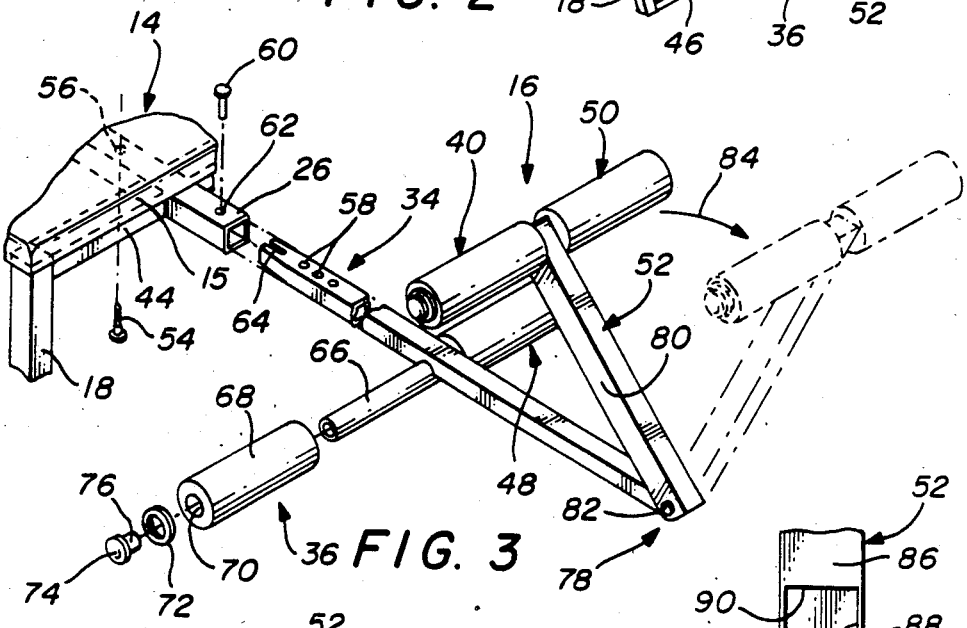
FIG. 3 is an isometric view of the foot anchor apparatus, illustrating the details thereof and its telescopic connection with the inclined platform.

FIG. 3 is a more detailed illustration showing the longitudinal platform support 26 extending beyond the inclined end 15 of the torso platform 14. The longitudinal support 26 is cross-sectionally square and is welded to the frontal lateral leg support 44. A fastener 54 is shown removed from a position from which it passes through a hole 56 in the longitudinal support 26 and into the bottom of the torso platform 14. As noted above, the frame connecting member 34 is of a cross-sectional shape which permits it to be slideable within the longitudinal support 26. A number of holes 58 are drilled in vertical registry through the top and bottom surfaces of the frame connecting member 34. A pin 60 can pass through the holes. A similar hole 62 is drilled through the top and bottom surface of the longitudinal support 26 so that the pin 60 can pass through both tubular sections 26 and 34 and fix the one part with respect to the other part. Plural holes are drilled in the frame connecting member 34 to provide a range of adjustments to accommodate exercisers of different heights. A slot 64 is formed in the top and bottom surfaces of the frame connecting member 34 so that the end thereof can slide past the fastener 54 which secures the longitudinal support 26 to the torso platform 14.

For facilitating the understanding of the invention, the foot anchor apparatus 16 shown in FIG. 3 illustrates the parts of the stationary foot support 36 as a removed assembly. The stationary foot support 36 comprises a stub pipe 66 welded to the frame connecting member 34. The stub pipe 66 is about seven inches in length so that a person's foot can be easily engaged thereover. The stub pipe 66 is about one inch in diameter. Covering the stub pipe 66 is a hollow roll of a closed cell foam material 68. A foam cushion suitable for use may be of the type similar to that used for insulating hot water pipes. The cushion 68 is not adhered to the stub pipe 66, but rather is allowed to turn or rotate thereon. The central opening 70 of the foam cushion 68 is insertable over the stub pipe 66 for easy installation. A washer 72 may also be inserted over the end of the stub pipe 66 to prevent the foam cushion 68 from being forced off the pipe 66. A conventional cap 74 with spring tines 76 is snapped into the open end of the pipe 66 to prevent the inadvertent removable of the washer 72 and the foam cushion 68. The other stationary support 48, as well as the movable foot supports 40 and 50 are comparably constructed.

The movable foot supports 40 and 50 are fastened to the pivotal section 52 which is constructed of a tubular member cross-sectionally similar to that of the longitudinal support 26. The tubular pivotal section 52 is of a length substantially identical to the distance between the end 78 of the frame connecting member 34 and the location of the stationary supports 36 and 48. With the tubular pivotal section 52 being somewhat larger in cross-sectional size than that of the frame connecting member 34, the sidewalls, one of which is shown as reference character 80 in FIG. 3, fit down over corresponding sidewalls of the frame connecting member 34. A bolt 82 is used to fasten the end of the tubular pivotal section 52 to the end of the frame connecting member 34, thereby providing a hinging or pivotal action between the tubular parts. The foot anchor apparatus 16 illustrated in FIG. 3 in solid lines represents the position when the movable supports 40 and 50 are rotated fully counterclockwise, while the broken lines illustrate the movable foot supports 40 and 50 when rotated fully to a clockwise direction, as noted by arrow 84.

According to an important feature of the invention, the clockwise and counterclockwise pivotal movement of the tubular pivotal section 52 is limited. In other words, the movable feet supports 40 and 50 cannot be moved counterclockwise into contact with the corresponding stationary foot supports 36 and 48. Also, the tubular pivotal section 52 cannot be rotated clockwise substantially more than that shown in FIG. 3. The feet supports 40 and 50 thus are not removed out of reach of an exerciser who wishes to pull the pivotal section 52 back with his toe into a foot anchor position. The total angular path of the tubular pivotal section 52 subtends an arch of about 75–80 degrees.

Figure 4:
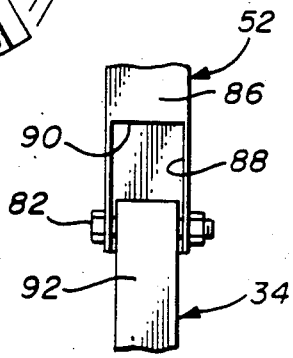
FIG. 4 is a partial view of the invention showing the hinging connection of the pivotal foot engaging part and a pivotal stop.
Figure 5:
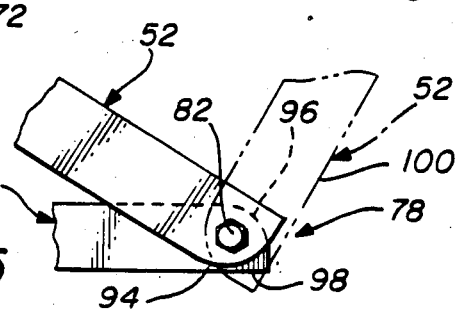
FIG. 5 is a side view of the pivotal connection illustrating the pivotal stop which limits clockwise rotation of the pivotal section.

FIGS. 4 and 5 illustrate the construction of the respective ends of the tubular pivotal section 52 and the frame connecting member 34 which provide the limited pivotal movement of the movable foot supports 40 and 50. The tubular pivotal section 52 is shown in FIG. 4 having a portion of the undersurface 86 removed, thereby forming a recess 88. The recess 88 is square in nature to accommodate the square outer surface of the frame connecting member 34. The transverse edge 90 of the recess 88 abuts with the frame connecting member top surface 92 when pivoted counterclockwise about bolt 82. The length of the recess 88 and thus the position with which the transverse edge 90 is formed along the longitudinal axis of the tubular pivotal section 52 determines the extent of counterclockwise rotation of the section 52.

In FIG. 5, the tubular pivotal section 52 is shown with rounded sidewall corners 94. This prevents a sharp edge on which clothing could catch and become damaged or ruined. The frame connecting member 34 also includes rounded corners 96 so that the sidewalls of the pivotal section 52 can rotate about the hinging bolt 82 without catching on a square corner of the connecting member 34. The lower corner 98 of the frame connecting member 34 is maintained rather square so that it abuts with the inside surface of the top wall of the tubular pivotal section 52 when such section is rotated clockwise, as shown in broken lines in FIG. 5. The abutment of the connecting member corner 98 thus forms a stop for limiting the clockwise movement of the tubular pivotal section 52.

The limited counterclockwise travel of the tubular pivotal section 52, forming spaced apart upper and lower feet supports, permits an exerciser to insert the ankles 38 of his right and left foot sideways between the stationary and movable foot supports without the use of his hands and thus without having to do so in a sitting position. It can be appreciated that when sitting on an inclined surface, it becomes very difficult to reach uphill and engage the feet within holders with the exerciser's hands. The limited clockwise travel of the tubular pivotal section 52 is also advantageous as the associated moveable supports 40 and 50 can be lifted or kicked out of the way when the exerciser desires to dismount from the therapy table. Because of the limited travel of the tubular pivotal section 52 in the clockwise direction, the moveable feet support 40 and 50 remain in an opened position. Thus, when the exerciser desires to engage his feet in the anchor apparatus 16, he need only lie on the torso platform 14, extend the toe of one foot under a moveable foot support 40 and 50 and swing the tubular pivotal section 52 counterclockwise. The pivotal section 52 will then fall into its counterclockwise stopped position near the front part of the exerciser's ankles. The cushions 68 encircling each foot support 36, 40, 48 and 50 prevent injury to exerciser's ankles on the falling of the moveable foot supports 40 and 50.

Figure 6:
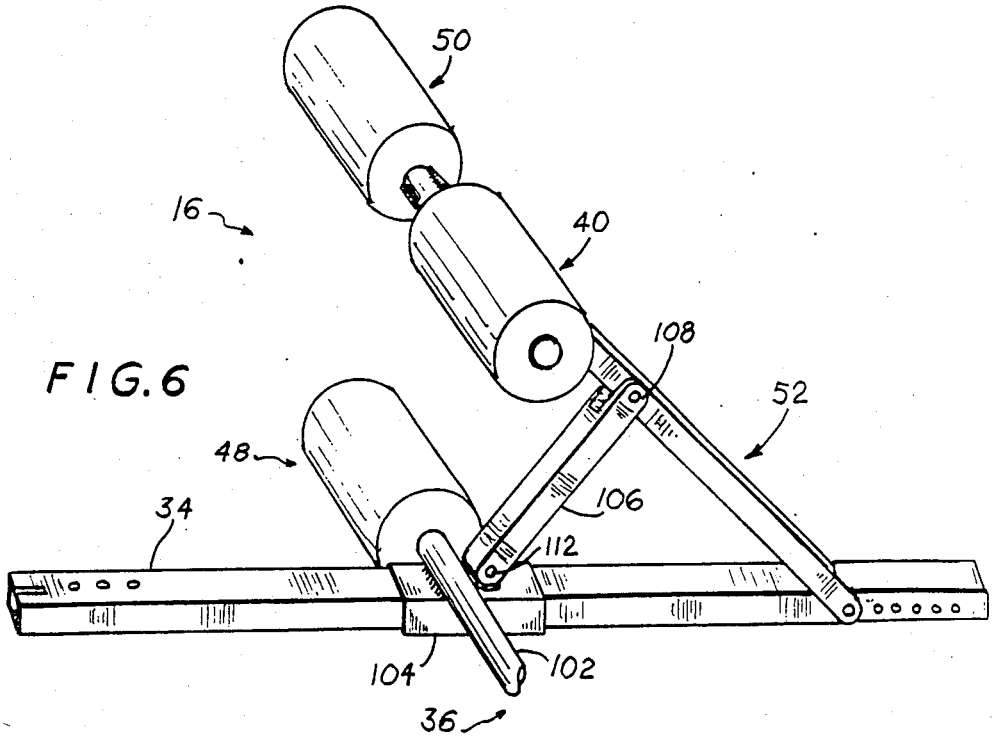
FIG. 6 is a perspective view of another embodiment of the invention in which the top and bottom lateral feet support bars are linked together so as to be moveable.

FIG. 6 illustrates another embodiment of the invention in which the lower cushioned support 36 and 48 are slideable along the frame connecting member 34, rather than being fixed thereto as in the above-described embodiment. Specifically, an elongate rod 102 to which the cushioned supports 36 and 48 are fastened is fixed to a short tubular section 104. The short tubular section 104 is of a cross-sectional shape similar to that of the frame connecting member 34, but slightly larger so that it can slide thereover. The transverse rod 102 can be fixed to the short tubular section 104 by welding, or other suitable means. The slideable tubular section 104 is connected to the pivotal section 52 by a connecting link 106. The connecting link 106 is also tubular in nature, with ears such as 108, at the upper end thereof. The ears 108 each have a hole therein and are pinned through the pivotal section 52. The connecting link 106 is thus pivotal with respect to the pivotal section 52. The bottom end of the connecting link 106 is also made pivotal with respect to the slidable tubular section 104 by a pin 112. An ear (not shown) with a hole in it may be welded to the top surface of the slidable tubular section 104 and connected therethrough by the pin 112 to the connecting link 106.

The arrangement by which the lower cushioned supports 36 and 48 are linked to the movable upper cushioned supports 40 and 50 allows the user of the therapy table of the invention to simply push on such lower supports 36 and 48 to open the feet engaging apparatus 16. Because the lower cushioned supports 36 and 40 are connected by the link 106 to the upper cushioned supports 40 and 50, movement of the lower supports 36 and 48 to the left in FIG. 6 operates to close the top and bottom cushioned supports together, thereby firmly engaging the anchor apparatus 16 about the user's feet. On the other hand, movement of the lower cushioned supports 36 and 48 to the right in FIG. 6 operates to open the feet engaging apparatus 16 for easy insertion therein of the user's feet. Importantly, when the user engages his feet in the anchor apparatus 16, and reclines on the platform 14, the pull exerted by the user's legs on the feet engaging apparatus 16 tends to tighten the ankle engagement. As a result, a person can completely relax in an inclined position, without concern of his feet slipping through the feet engaging apparatus 16. Due to the resiliency of the cushioning on the upper supports 40 and 50 and the lower supports 36 and 48, a person can move his feet sideways out of engagement with the feet engaging apparatus 16 to dismount the therapy table.

From the foregoing, it can be seen that an improved therapy table has been disclosed. According to the invention, the therapy table includes a torso platform which accommodates generally only the torso portion of the exerciser. The torso platform is elevated or inclined to provide a reverse gravity effect on the organs of the exerciser. Attached to the torso platform is an adjustable foot anchor apparatus which prevents the exerciser from inadvertently sliding down the incline of the torso platform. In one embodiment, the foot anchor apparatus includes a pair of stationary foot supports for engaging the back surface of the exerciser's ankles. A pair of moveable foot supports are made pivotal with respect to the stationary supports for swinging near or into engagement with the front of the exerciser's ankles. The moveable foot supports are provided with limited clockwise and counterclockwise travel. In another embodiment of the invention, the lower feet supports are made laterally slideable on the frame connecting member, and are linked to the pivotal section of the upper feet supports so that by pushing or pulling on the lower feet supports, the feet engaging apparatus can be closed or opened about the patient's feet.

While the preferred embodiments of the invention has been disclosed with reference to a specific therapy table, it is to be understood many changes in detail may be made as a matter of engineering choice without departing from the scope of the invention as defined by the appended claims.

I claim:

1. Apparatus for anchoring a person's feet to an object, comprising:

foot engaging means attachable to said object for anchoring the feet of the person, said foot engaging means including lower foot support means for engaging one area of the person's feet, said lower foot support means being movable toward and away from the person, and including upper foot support means pivotally fixed to said foot engaging means for swinging into a position proximate another area of the person's feet to thereby anchor the feet to said foot engaging means, and means for linking said lower foot support means to said upper foot support means so that when said lower foot support means is pushed away from the person said upper and lower foot support means open, and when said lower foot support means is moved toward said person said upper and lower foot support means close together to thereby capture the person's feet and anchor the feet.

2. The apparatus of claim 1 wherein said object comprises a table of a length so as to accommodate generally only the torso of the person.

3. The apparatus of claim 1 wherein said foot engaging means includes an elongate telescopic section connecting said foot engaging means to said object.

4. The apparatus of claim 3 wherein a portion of the telescopic section is fixed under said platform and extends substantially the entire length thereof.

5. The apparatus of claim 3 wherein said lower foot support means is longitudinally slideable on said telescopic section.

6. The apparatus of claim 5 wherein said lower foot support means is connected to said upper support means by a link pivotally connected at each and thereof to said upper and lower foot support means.

7. The apparatus of claim 1 further including stop means for limiting the pivotal travel of said upper foot support means when pivoted in a direction toward said lower foot support means so that said upper foot support means is spaced apart from said lower foot support means about the distance corresponding to the diameter of the person's ankles.

8. The apparatus of claim 1 wherein said lower foot support means comprises a first pair of stub shafts each fixed to a frame member and extending in opposite directions therefrom for engagement with the backside of the person's ankles, and said upper foot support means comprises a second pair of stub shafts fixed transverse to a pivotal section, said pivotal section being pivotally mounted to said frame member.

9. The apparatus of claim 8 wherein each said stub shaft of said first and second pair further includes a padded covering encircling each said shaft, and means for allowing rotation of movement of said padded covering with respect to the associated stub shafts.

10. A therapy table, comprising:

a platform on which an exerciser may recline, said platform having a length for accommodating generally only the trunk of an exerciser;

means for inclining said platform;

anchor means attached to said platform for anchoring the feet of an exerciser so as to prevent the exerciser from sliding down the incline of said platform, said anchor means including a first and second means, one said first or second means for engaging the exerciser's feet on the front side of the ankle, and the other said means for engaging the person's ankles on the backside thereof;

a link connecting said first and second means for moving one said first or second means with respect to the other means for facilitating the placement of the exerciser's feet therebetween; and a slender elongate frame connecting member connecting said anchor means to said platform so that the exerciser can assume an initial sitting position on the upper inclined end of the platform, wherein the exerciser's legs can straddle the connecting member and depend downwardly between said inclined end of said platform and said anchor means.

11. The therapy table of claim 10 wherein said slender connecting frame is adjustable lengthwise for providing various positions of the anchor means with respect to said platform.

12. The therapy table of claim 11 wherein said first means is pivotally mounted to said slender connecting member.

13. The therapy table of claim 12 further including a stop for limiting the pivotal travel of said first means toward said second means.

14. The therapy table of claim 12 further including a stop for limiting the pivotal travel of said first means away from said second means.

15. The therapy table of claim 12 wherein said second means is slidable along a longitudinal axis of said slender connecting member.

16. A therapy table, comprising:

an inclined platform;

feet engaging means attachable to said platform for anchoring the feet of an exerciser reclining on said platform, said feet engaging means including an elongate connecting member connecting said feet engaging means to said platform, a lower feet support slideable along said elongate connecting member, an upper feet support member pivotally connected to said elongate connecting member, and linking means for connecting said lower feet support to said upper feet support member so that when said upper feet support member is moved, said lower feet support is also moved.

17. The therapy table of claim 16 wherein said linking means comprises a rigid link pivotally connected at each end thereof proximate said upper support member and said lower feet support such that when said lower feet support is moved in one direction said upper feet support member and said lower feet support close together, and when moved in an opposite direction said upper feet support member and said lower feet support move away from each other.

* * * * *